United States Patent [19]

Lee

[11] Patent Number: 4,875,612

[45] Date of Patent: Oct. 24, 1989

[54] GUIDED HAMMER

[76] Inventor: Lawrence L. Lee, 3776 Martha St., San Diego, Calif. 92117

[21] Appl. No.: 228,976

[22] Filed: Aug. 5, 1988

[51] Int. Cl.[4] ..... B25L 7/00

[52] U.S. Cl. ..... 227/147; 74/110; 173/90

[58] Field of Search ..... 29/254; 74/110; 173/90; 227/113, 129, 130, 147, 156

[56] References Cited

U.S. PATENT DOCUMENTS

| | | | |
|---|---|---|---|
| 52,799 | 2/1866 | Winter | 173/90 X |
| 1,406,027 | 2/1922 | Kabigting | 227/147 X |
| 2,587,944 | 3/1952 | Williams | 227/147 |
| 2,829,370 | 4/1958 | Humbert | 227/147 |
| 2,864,525 | 12/1958 | Hamlin et al. | 218/34 |
| 3,036,482 | 5/1962 | Kenworthy et al. | 81/52.35 |
| 3,042,004 | 7/1962 | Fischer et al. | 121/32 |
| 4,241,795 | 12/1980 | Landry, Jr. | 173/90 |
| 4,290,493 | 9/1981 | Smith et al. | 173/124 |
| 4,416,172 | 11/1983 | Medinger | 227/113 X |
| 4,662,557 | 5/1987 | Lee | 227/147 |

*Primary Examiner*—Paul A. Bell

[57] ABSTRACT

An improved impact apparatus of the type in which an impact member delivers an impact to a work piece, an elongated guide confines the motion of the impact member to within a predetermined path, an input handle receives the input movement, and a speed multiplying mechanism transmits the input movement to the impact member. The input movement is received as an input force along an input axis causing the input handle to move at an input velocity. This input is transformed by the speed multiplying mechanism into an output force along an output axis, causing the impact member to move at an output velocity which is faster than the input velocity. For apparatus in which the speed multiplying mechanisms are not axially symmetric, thus having output axis laterally displaced from the input axis, the present invention provides improved positioning of the input and output axes along lines that pass near the center of gravity of the impact member, thus minimizing the unwanted torque on the moving parts. By reducing the unwanted torque on the moving parts, friction and the risk of binding are reduced. The use of these improvements enables the apparatus to be made of less-costly materials and be constructed with less precision.

11 Claims, 4 Drawing Sheets

FIG. 3
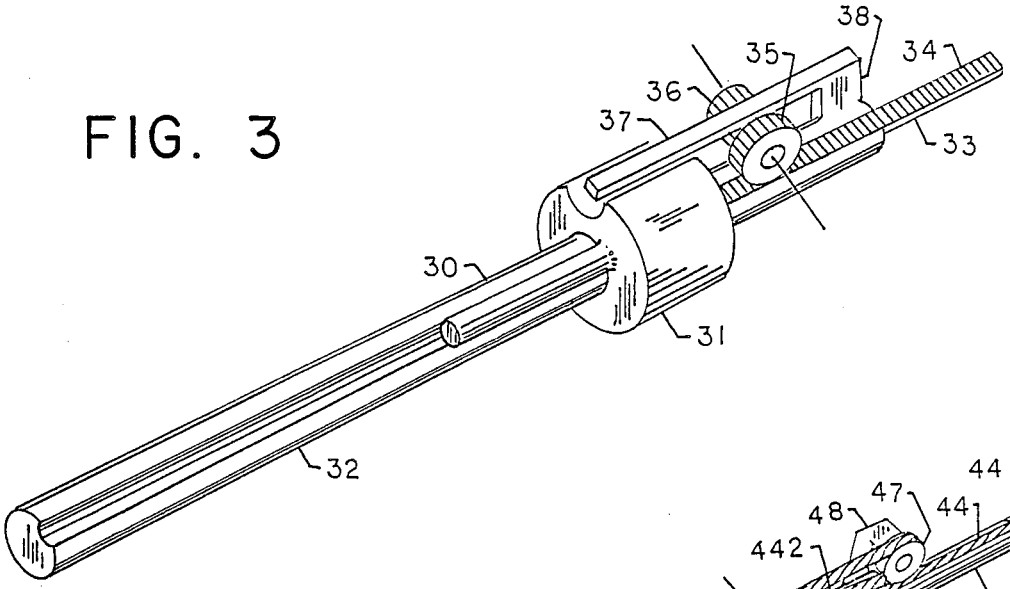
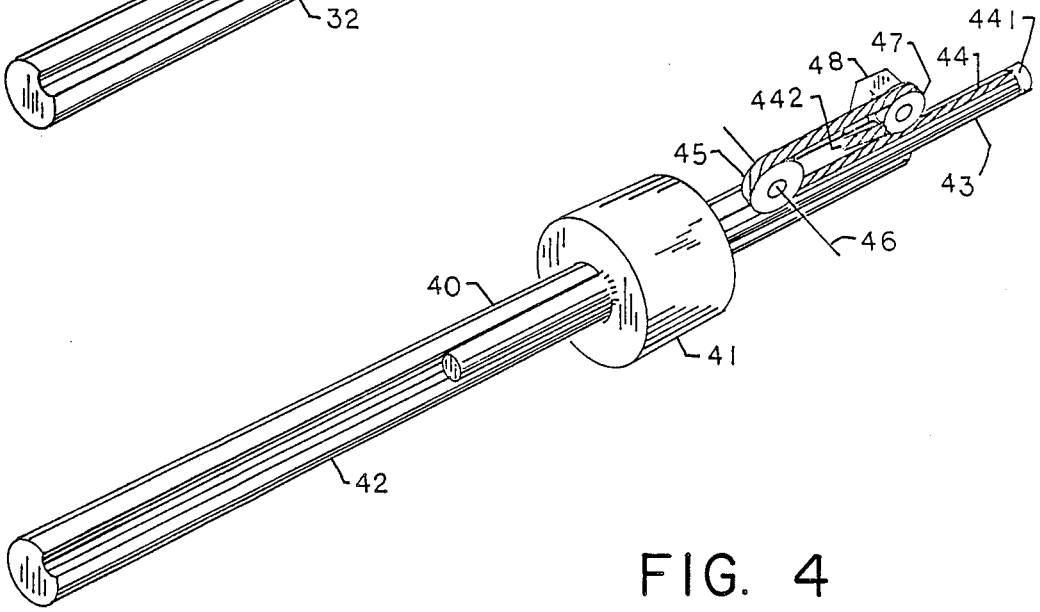
FIG. 4

GUIDED HAMMER

BACKGROUND OF THE INVENTION

The present invention relates to hand tools, and pertains particularly to an improved impact tool.

The hand held and manipulated hammer is perhaps one of the oldest, most widely used, and most powerful tool known to man. Hammers can produce very large forces by making use of the sudden change of momentum upon impact: the change of momentum is equal to the force integrated over time, since the time of impact is infinitesimally small, the force can be very large. Momentum is at the foundation of the hammer's usefulness. Most hammers that are presently in common use have heavy impact members (hammerheads) mounted at the end of long handles to provide the leverage which gives the hammerhead speed and momentum. However, motion of the hammerhead at the end of a long handle is difficult to control, and so much power in unskilled hands becomes dangerous. Many fingers have been injured while performing jobs as simple as driving a nail.

A guide directed hammer has recently been invented. This invention is described in U.S. Pat. No. 4,662,557, it will be referred to herein as the "prior art patent". The apparatus has an impact member to deliver the momentum to a work piece. The impact member slides along a guide which confines the movement of the impact member to within a predetermined path leading to the work piece. Thus the risk of injuries due to poorly directed hammerhead is minimized. Input movement to the device is received through input means which includes a handle. In use, the handle is grasped by the user's hand and pushed forward while the forward end of the guide is pushed against the stationary surface to be nailed. A speed multiplying mechanism transforms the input movement to the output movement of the impact member, driving the impact member to move at several times the speed of the hand that pushes the device's handle. The speed multiplying mechanism thus provides the speed multiplying benefit of a long-handled hammer, but it does so without letting the impact member fly out of control.

The prior art patent describes several possible mechanisms for accomplishing the purpose of speed multiplication. These mechanisms include (1) cable and pulleys, (2) levers, (3) rack and pinion gears, and (4) hydraulic or pneumatic cylinders. Each one of these mechanisms has its unique advantages and peculiar difficulties in implementation.

One of the difficulties is the introduction of unwanted torques to the apparatus' moving parts. For example, in the case of the impact member during impact, a very large force is applied to the work piece, if this force had been applied along an axis that does not pass near the impact member's center of gravity, a very large torque will be generated to act on the impact member. Such a large torque can quickly destroy the impact member or the part of the guide around the impact position. It was realized in the prior art patent that the impact with the work piece must always produce a force along an axis that passed very near to the impact member's center of gravity. However, other smaller torques, which can have important effects on the apparatus' efficiency have been mostly ignored in the prior art:

While the impact member is accelerating towards the operative position (the position of impact), it is driven by a force from the speed multiplying mechanism. This driving force is the output force of the speed multiplying mechanism, it is applied along the output axis, and generates an output movement. If the output axis is not positioned along a line through the impact member's center of gravity, then a torque will be generated to act on the impact member.

In the case of the speed multiplying mechanism, an input force is applied along an input axis, and the mechanism delivers an output force along the output axis, if the input and output axes are not colinear, then a torque is generated to act on the speed multiplying mechanism. The embodiments shown in FIGS. 1–5 in the prior art patent all have assymetric speed multiplying mechanisms that are potential sources of unwanted torques.

Most of the torques generated by off-center forces are undesirable because they cause the moving parts to exert lateral forces on the support members. These lateral forces generate friction, causing the parts to "bind". The binding frictions are often self-regenerating, so once binding is started somewhere, it becomes progessly worse. And if the parts become deformed, then they bind even more. Therefore, whenever unwanted torques are present to the extend of threatening to bind, it becomes necessary to use very rigid parts to prevent deformation.

The binding effect of unwanted torques can be minimized by the use of precision parts and low friction bearings (such as ball bearings). However, the use of these parts make the apparatus costly. Such costs can be avioded by not having too much unwanted torque in the first place. And it is the purpose of the present invention to cut down on the unwanted torques on the moving parts.

Different moving parts of the impact apparatus are effected to different degree by unwanted torques. In general, the fastest-moving parts are affected most adversely by the unwanted torques. So torque on the impact member causes more trouble than an equal torque on the guide. In some situations, it may be acceptable (in fact sometimes even desirable) to increase torque the guide or on the handle in order to reduce torque on the impact member.

SUMMARY OF THE INVENTION:

The object of the present invention is to provide an improved impact apparatus of the type in which an impact member delivers an impact to a work piece, an elongated guide confines the motion of the impact member to within a predetermined path, an input handle receives the input movement, and a speed multiplying mechanism transmits the input movement to the impact member. The input movement is received as an input force along an input axis causing the input handle to move at an input velocity. This input is transformed by the speed multiplying mechanism into an output force along an output axis, causing the impact member to move at an output velocity which is faster than the input velocity. For apparatus in which the speed multiplying mechanisms are not axially symmetric, thus having output axis laterally displaced from the input axis, the present invention provides improved positioning of the input and output axes. In one preferred embodiment, the output axis is positioned along a line that passes near the center of gravity of the impact member in order to minimizing the unwanted torque on the impact member. By reducing the unwanted torque on the impact member, friction and the risk of binding are reduced. The use of these improvements enables the apparatus to be made of less-costly materials and be constructed with less precision.

BRIEF DESCRIPTION OF THE DRAWINGS

FIG. 3 is a perspective view of another preferred embodiment of the present invention.

FIG. 4 is a perspective view of still another preferred embodiment of the present invention.

DETAILED DESCRIPTION OF THE INVENTION

Figures 1, 1A:
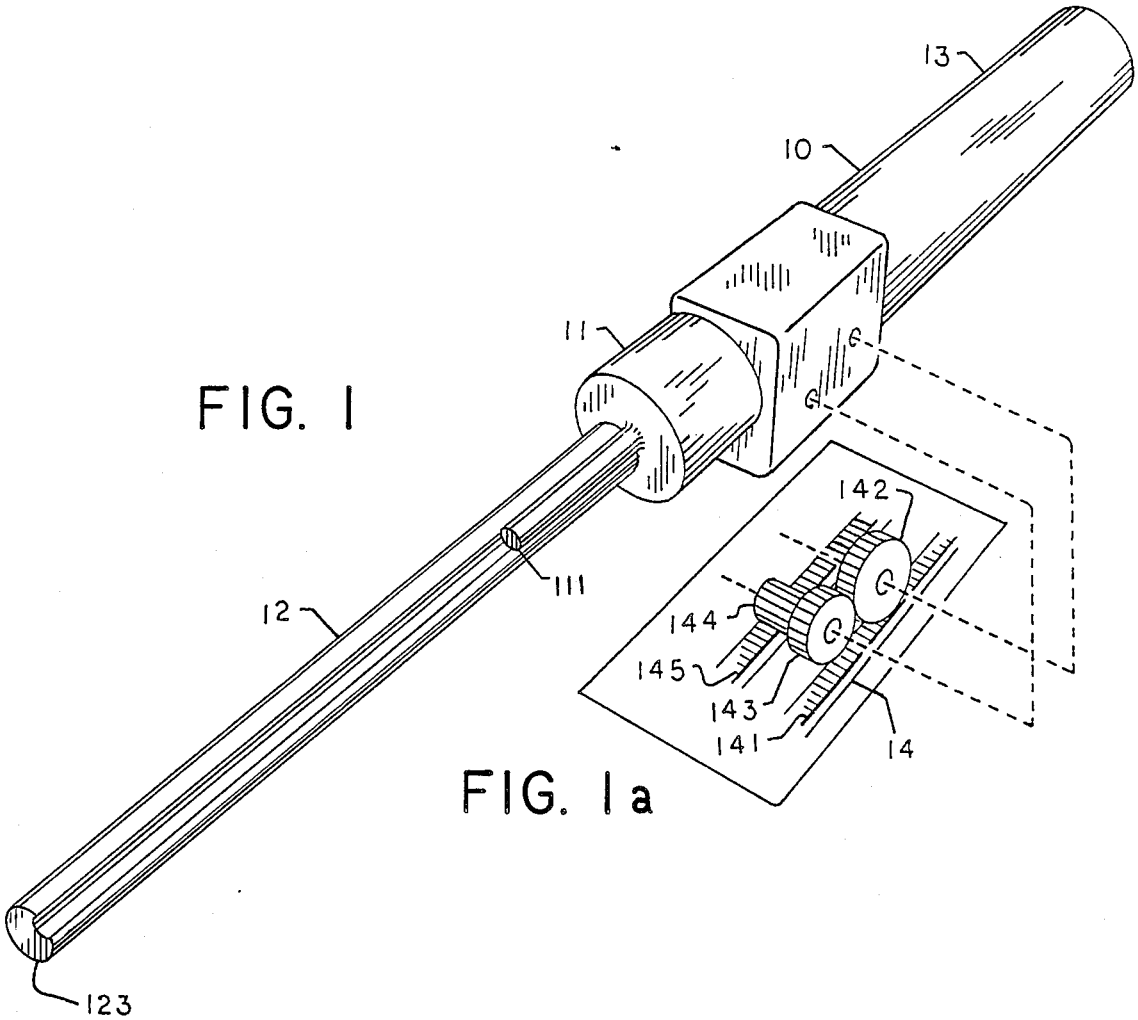
FIG. 1 is a perspective view of one preferred embodiment of the present invention.
FIG. 1*a* is a perspective view of some internal part of the apparatus of FIG. 1 viewed with a mirror through a transparent bottom part of the housing.

One preferred embodiment of the present invention is shown in FIG. 1. This improved impact apparatus 10 comprises an impact member 11, an elongated guide 12, input means 13, and speed multiplying means 14. In the embodiment of FIG. 1, the speed multiplying mechanism 14 is a set of rack and pinion gears. These gears are hidden from view in FIG. 1, but they are shown in FIG. 1*a*, viewed with a mirror through the transparent bottom of the apparatus 10.

Figure 2:
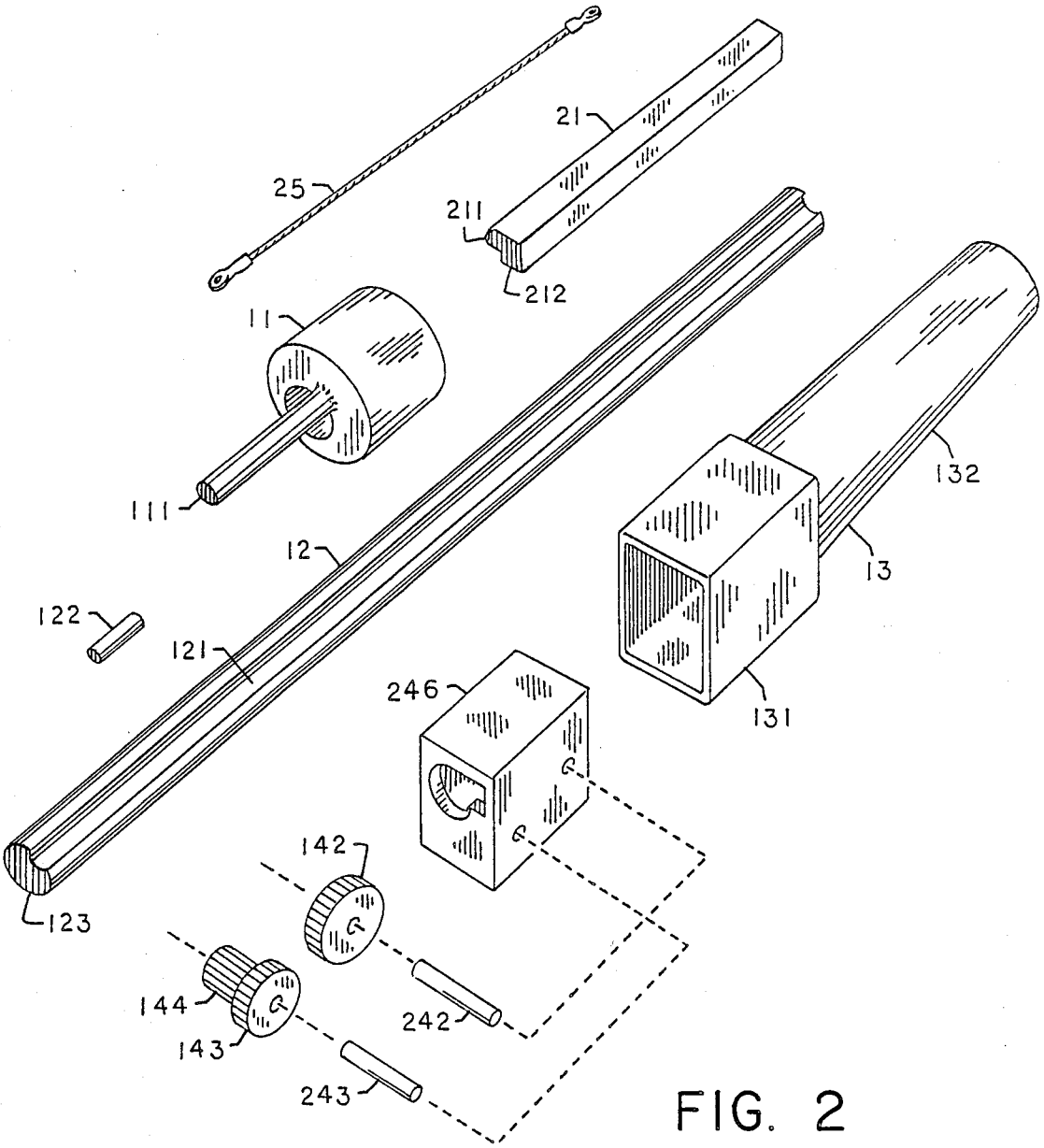
FIG. 2 is a perspective view of the unassembled parts that are used in the construction of the apparatus of FIG. 1.

The various parts of the apparatus of FIG. 1 are shown unassembles in FIG. 2. Parts shown in FIG. 2 are labelled with the same numerals as the corresponding parts shown in FIG. 1.

Guide 12 is substantially straight and uniform in crossection. It has a longitudinal groove 121 throughout its length. Impact member 11 is free to slide along guide 12. Impact member 11 has an impact face 111 which fits into the groove 121. The impact face 111 fills the entire crossection of the groove, so any work piece (for example a nail) that is placed in the groove 121 will be struck by the impact face.

A magnet 122 is imbedded into the guide 12 near its operative position 123. This magnet serves as a nail holder. A nail placed near the magnet is automatically attracted into the groove 121 to be struck by the impact face 111.

The forward movement (towards the operative position 123) of the impact member 11 is driven by the output member 21 which pushes the impact member 11 from behind.

The output member 21 has a guided side 211 which is shaped to fit into the groove 121 of the guide 12. The groove 121 also serves as a track along which the output member 21 can slide while supporter by the guide 12. Another side 212 of the output member 21 has the teeth of a rack gear 141. This gear 141 is the output rack gear, it is located at the bottom of the output member 21 and is hidden from view in both FIG. 1 and FIG. 2, but some of it can be seen in FIG. 1*a*.

In the embodiment of FIG. 1, the output rack gear 141 is meshed to and driven by an output pinion gear 142. The output pinion is driven by an intemediate gear 143 which is integrated into and rotates with the input pinion gear 144. The input pinion gear 144 is driven by the input rack gear 145 which is integrated into the bottom of the guide 12.

The pinion gears 142, 143 and 144 are free to rotate around axles 242 and 243 respectively. The axles 242 and 243 are fixed to a gearbox 246 which fits into the gearbox cover 131. The gearbox cover 131 is an integral part of the input means 13. The other part of the input means 13 is a handle 132.

In action, the operative end 123 of guide 12 is positioned against a steady surface to be nailed. So the guide 12 and the input rack gear 145 are stationary. The handle 132 is grasped by the user's hand and pushed forward. The gear box 246 and all the pinion gears 142–144 move with the handle 132. The relative motion between the input rack gear 145 and the input pinion gear 144 causes the pinion 144 to rotate in the CCW direction (as viewed in FIG. 1*a*). Gear 143 moves with gear 144, but the output pinion gear 142 rotates in the opposite direction causing the output rack gear 141 to move forward.

In a typical model of this embodiment, the input pinion 144 gear would have twelve (12) teeth, the intemediate gear 143 twenty (20) teeth, the output pinion gear twenty four (24) teeth, the teeth are all the same size, therefore the relative velocity of the output rack gear 141 is 20/12 times that of the input rack gear as observed in a reference frame moving with the gear box. The speed of the output member 21 and the impact member 11 is therefore $1+(20/12)$, which turns out to be approximately three times, that of the input means 13.

A spring 25 is provided to return the impact member 11 from the operative position 123 to a rest position by the gear box 246. Spring 25 is attached at one end to the impact member 11 and at the other end to the butt end of the handle 132.

Figure 5:
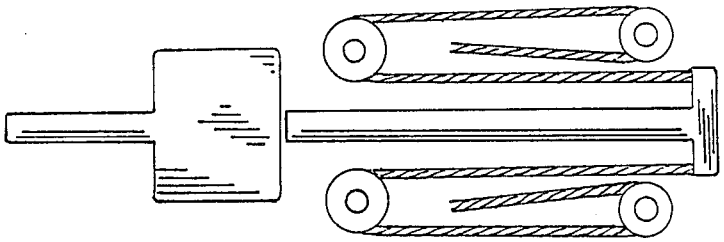
FIG. 5 is a plan view of another preferred embodiment of the present invention.

The embodiment of FIG. 1 operates on the same principle as the embodiment shown in FIG. 5 of U.S. Pat. No. 4,662,557. By using an additional pinion gear 142 to reverse the direction of the output pinion gear, the present invention has made it possible to place both the input and output rack gears on the same side of the pinion gears thereby enabling positioning of the input and output axes near each other and near the center of gravity of the impact member. Also, having the input and output axes close together makes it possible for the input and output rack gears to be placed alongside of the guide and be supported by the guide. In contrast, in the embodiment described in the prior art patent, the input and output rack gears must be positioned on opposite sides of the pinion gears, they must therefore be separated by a distance at least equal to the sum of the radii of the pinion gears. Therefore the input and output axes cannot be simultaneously positioned very near to the impact member's center of gravity.

The positioning means in this preferred embodiment of the present invention are the components and modifications that enabled the input and output rack gears to be positioned as shown in FIG. 1.

With the improvement provided by the present invention, the mechanical parts of the impact apparatus need not be made of very rigid material, and need not be constructed with great precision. Models of the preferred embodiment of FIG. 1 have been made with plastic gears, plastic handles, plastic gear boxes, and even plastic guides. Models made with nylon guides 30 cm long, 1.2 cm in diameter functioned quite well although the guides are deformable to the extend of being bent by as much as twenty degrees.

Another preferred embodiment of the present ivention is shown in FIG. 3. This improved impact apparatus 30 has an impact member 31 which is free to slide along a guide 32. Forward movement of the impact member 31 is driven by an output member 33 which is also free to slide along the guide 32. Output member 33 is so positioned that the output force on the impact member 31 is applied along an output axis which points directly to the center of gravity of the impact member 30. The output member 33 comprises an output rack gear 34 which is driven by an output pinion gear 35. The output pinion gear 35 and the input pinion gear 36 are integrated into one single piece and they rotate around a common axle which is fixed to an input means. The input means of the apparatus 30 is not shown in FIG. 3; but its features are similar to those of the input means 13 for the apparatus 10 of FIG. 1.

The input pinion gear 36 is meshed to an input rack gear 37. The input rack gear 37 is fixed to guide 32 by means of a post 38. So gear 37 remains stationary in operation. As the pinion gears move forward with the input means, they also rotate in the clockwise direction, thus pushing the output member in the forward direction at an increased velocity.

The input force for the apparatus of FIG. 3 is applied along an input axis which passes through the position where pinion gear 36 meshes with rack gear 37. This input axis is positioned relatively far away from the guide 32 and from the impact member's center of gravity. Fortunately, the input rack gear needs to be anchored only to the guide 32 which is stationary and is one of the strongest components in the apparatus. The arrangement of FIG. 3 is therefore a substantial improvement over the apparatus of the prior art where the output axis is positioned away from the guide and from the impact member's center of gravity. Compared to the embodiment of FIG. 1, the embodiment of FIG. 3 uses one fewer pinion gear but requires more elaborate off-center support structures.

A third preferred embodiment of the present invention is shown in FIG. 4. The apparatus 40 of FIG. 4 comprises an impact member 41, a guide 42, and an output member 43 that drives the impact member 41. Cable 44 is attached at one end 441 to the output member 43, so it can pull the output member 43 forward. Cable 44 is then wrapped around pulley 45 which rotates around axle 46. Axle 46 is fixed to the apparatus' input means. The input means is not shown in FIG. 4 so the speed multiplying mechanism can be revealed. The input means of the apparatus of FIG. 4 is also quite similar to the input means 13 of the apparatus of FIG. 1.

Rope 44 continues to wrap around another pulley 47 which turns around an axle that is fixed to guide 42 through a post 48. The second end 442 of the rope 44 is anchored to the apparatus' input means and thus moves with gear 45. The cable and pulley mechanism shown in FIG. 4 provides a speed multiplication factor of three.

The apparatus of FIG. 4 is similar in operation to the apparatus of FIGS. 1–3 in the prior art patent. The improvement provided by the present invention is the positioning of the output axis nearer to the impact member's center of gravity thereby enabling the use of an output member 43 that is positioned along the guide and is supported by the guide 42. The positioning means in this preferred embodiment of the present invention are the components and modifications that enabled the output members to be positioned as shown in FIG. 4. In contrast, the apparatus of FIG. 1–3 in the prior art patent positioned the centers of the pulleys near the guide, the output axis is then positioned so far away that a rigid self-supporting rod has to be provided to propel the impact member in the forward direction. With improvements provided by the present invention, the apparatus of FIG. 4 requires much less precision in construction and can made with many inexpensive plastic parts.

A simple and general method to position the input and/or output axes along a line that pass through the impact member's center of gravity is illustrated in FIG. 5: By connecting two or more similar sets of speed multiplying mechanisms in parallel and positioning them symetrically around an axis of symmetry, the resultant input and output axes are placed along the axis of symmetry. These axes can then be positioned to pass through the impact member's center of gravity.

The apparatus of FIG. 5 uses cable and pulley speed multiplying means, but the same effects can also be achieved by using symmetrically placed speed multiplying mechanisms using gears or levers.

Figure 6:
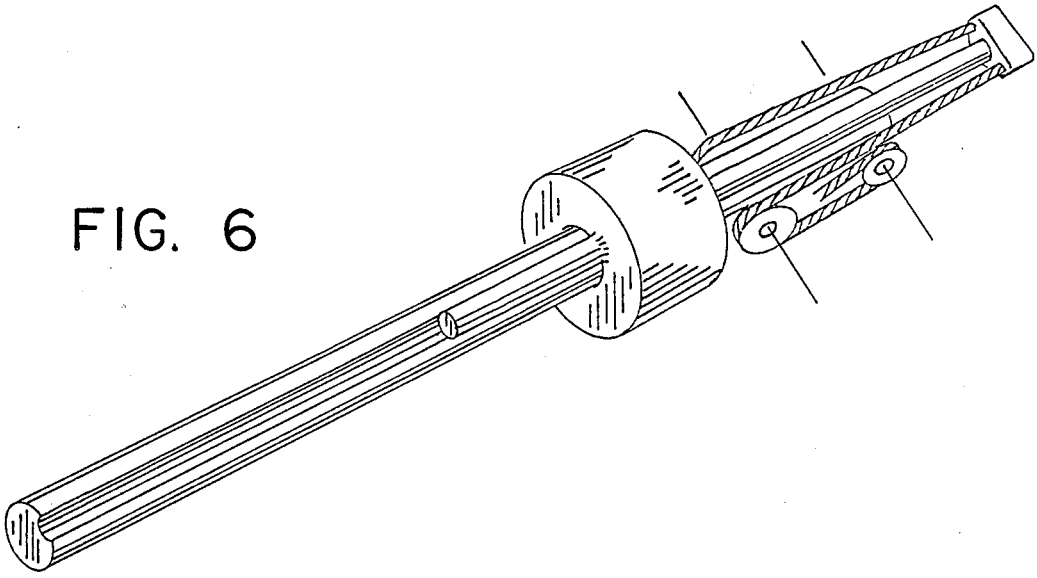
FIG. 6 is a perspective view of still another preferred embodiment of the present invention.

A variation of the embodiment of the FIG. 5 is shown in FIG. 6. In this variation, two cable-and-pulley speed multiplying means are placed symmetrically about a plane of symmetry. The output axis is thus positioned along a line passing through the impact member's center of gravity. But the input axis is not so centrally positioned. The configuration of FIG. 6 is not as symmetrical as the configuration of FIG. 5, but it enables the apparatus to be made more compact.

I claim:

1. An improved impact apparatus of the type in which an impact member delivers an impact to a work piece;

an elongated guide means confines the motion of said impact member to within a predetermined path;

an input means receives input movement, said input movement being received as an input force along an input axis causing the input means to move at an input velocity; and a speed multiplying means transmits the input movement to said impact member as an output force along an output axis, causing the impact member to move at an output velocity which is faster than said input velocity;

wherein the improvement comprises:

a guide means having a longitudinal groove of uniform crossection near its operative position, an impact member having an impact face that fills the crosssectional area of the groove such that any work piece that has been placed into said groove will be struck by said impact face.

2. An improved impact apparatus of the type in which an impact member delivers an impact to a work piece;

an elongated guide means confines motion of said impact member to within a predetermined path;

an input means receives input movement, said input movement being received as an input force along an input axis causing said input means to move at an input velocity; and a speed multiplying means transmits the input movement to said impact member as an output force along an output axis, causing the impact member to move at an output velocity which is faster than said input velocity; said speed multiplying means comprising a plurality of rack and pinion gears;

wherein the improvement comprises:

at least two pinion gears centered around at least two separate axles to enable at least two rack gears to be positioned on the same side of the pinion gears.

3. An improved impact apparatus of the type in which an impact member delivers an impact to a work piece;

an elongated guide means confines motion of said impact member to within a predetermined path;

an input means receives input movement, said input movement being received as an input force along an input axis causing the input means to move at an input velocity; and a speed multiplying means transmits the input movement to said impact member as an output force along an output axis, causing the impact member to move at an output velocity which is faster than said input velocity; the output axis being laterally displaced from the input axis;

wherein the improvement comprises:

positioning means to position the output axis along a line that passes near the center of gravity of the impact member thereby minimizing the torque applied to the impact member, said torque causing increase of friction between the impact member and the guide means.

4. An improved impact apparatus according to claim 3 wherein the improvement further comprises positioning means to position the input axis near the output axis.

5. An improved impact apparatus according to claim 4 wherein said speed multiplying means comprises:

an output rack gear located along the output axis which runs near the impact member's center of gravity;

an output pinion gear located with its center at approximately one radius distance away from the output axis such that this output pinion gear meshes with the output rack gear;

an input rack gear located along the input axis which also runs near the impact member's center of gravity;

an input pinion gear located with its center at approximately one radius distance away from the input axis such that this input pinion gear meshes with the input rack gear;

the output pinion gear being mechanically connected to the input pinion gear, and is driven by the input pinion gear through this mechanical connection.

6. An improved impact apparatus according to claim 5 wherein said input pinion gear is integrated to an intermediate gear which rotates with the input pinion gear around a common axle, said intermediate gear being meshed to the output pinion gear and drives the output pinion gear.

7. An improved impact apparatus according to claim 5 wherein said output pinion gear is integrated to an intermediate gear which rotates with the output pinion gear around a common axle, said intermediate gear being meshed to the input pinion gear and is driven by the input pinion gear.

8. An improved impact apparatus according to claim 4 wherein the positioning means comprised a second speed multiplying means which is similar to the first speed multiplying means, the second speed multiplying means being connected in parallel with said first speed multiplying means, and the second speed multiplying means being positioned on the opposite side of the impact member's center of gravity from the first speed multiplying means; the use of more than one speed multiplying means connected in parallel places the resultant input and output axes at a position in between the input and output axes of the individual speed multiplying means, the resultant input and output axes are thereby positioned nearer to the impact member's center of gravity.

9. An improved impact apparatus according to claim 3 wherein the improvement further comprises an output member to deliver output movement to the impact member; said output member being supported along a track along said guide, and delivers the output movement along an output axis which is positioned near the impact member's center of gravity.

10. An improved impact apparatus according to claim 9 wherein said speed multiplying means comprises a cable attached at one end to said output member;

a pulley located with its center at approximately one raduis distance away from the output axis such that the output axis runs along a tangent to a rim of the pulley, and positioning means to support the centers of the pulleys which are located away from the output axis.

11. An improved impact apparatus according to claim 3 wherein said speed multiplying means comprises:

a rack gear located along the output axis which runs near the impact member's center of gravity;

a pinion gear located with its center at approximately one radius distance away from the output axis such that this pinion gear meshes with the rack gear along the output axis; and positioning means to support the rack and pinion gears that are located away from the output axis.

* * * * *